US011392062B2

(12) United States Patent
Gila et al.

(10) Patent No.: US 11,392,062 B2
(45) Date of Patent: Jul. 19, 2022

(54) IMAGE FORMATION WITH IMAGE-RECEIVING HOLDER AND IMAGE FORMATION MEDIUM

(71) Applicant: Hewlett-Packard Development Company, L.P., Spring, TX (US)

(72) Inventors: Omer Gila, Palo Alto, CA (US); Napoleon J Leoni, Palo Alto, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/054,506

(22) PCT Filed: Sep. 12, 2018

(86) PCT No.: PCT/US2018/050646

§ 371 (c)(1),
(2) Date: Nov. 10, 2020

(87) PCT Pub. No.: WO2020/055393

PCT Pub. Date: Mar. 19, 2020

(65) Prior Publication Data

US 2021/0191292 A1 Jun. 24, 2021

(51) Int. Cl.

| | |
|---|---|
| ***G03G 15/16*** | (2006.01) |
| ***G03G 15/01*** | (2006.01) |
| ***G03G 21/00*** | (2006.01) |
| ***B41J 2/005*** | (2006.01) |
| ***B41J 2/215*** | (2006.01) |
| ***G03G 15/11*** | (2006.01) |

(Continued)

(52) U.S. Cl.

CPC ..... *G03G 15/1635* (2013.01); *B41J 2/0057* (2013.01); *B41J 2/215* (2013.01);

(Continued)

(58) Field of Classification Search

CPC .... G03G 15/1635; G03G 13/10; G03G 13/11; G03G 15/0131; G03G 15/10;

(Continued)

(56) References Cited

U.S. PATENT DOCUMENTS

| | | | |
|---|---|---|---|
| 6,385,405 | B1 | 5/2002 | Kingsland |
| 7,677,716 | B2 | 3/2010 | Vega et al. |

(Continued)

FOREIGN PATENT DOCUMENTS

| | | | |
|---|---|---|---|
| JP | 2000190550 | A | 7/2000 |
| JP | 2007-190745 | A | 8/2007 |

(Continued)

*Primary Examiner* — Ryan D Walsh

(74) *Attorney, Agent, or Firm* — Dicke Billig & Czaja PLLC

(57) ABSTRACT

An image formation device includes a transfer member and a first portion to receive an electrically charged, image-receiving holder onto the transfer member. A second portion downstream from the first portion is to receive droplets of ink particles within a dielectric carrier fluid onto the electrically charged, image-receiving holder to form at least part of an image. A charge source is to emit airborne charges to charge the ink particles to move, via attraction relative to the image-receiving holder, through the carrier fluid to become electrostatically fixed relative to the image-receiving holder. A liquid removal unit is to remove at least the carrier fluid from at least a surface of the image-receiving holder. A transfer station is to transfer the ink particles of the image and the image-receiving holder together from the transfer member to an image formation medium.

16 Claims, 6 Drawing Sheets

(51) Int. Cl.
*G03G 15/10* (2006.01)
*G03G 13/11* (2006.01)
*G03G 13/10* (2006.01)

(52) U.S. Cl.
CPC ..... *G03G 13/10* (2013.01); *G03G 13/11* (2013.01); *G03G 15/0131* (2013.01); *G03G 15/10* (2013.01); *G03G 15/11* (2013.01); *G03G 15/163* (2013.01); *G03G 21/0088* (2013.01); *G03G 2215/0658* (2013.01)

(58) Field of Classification Search
CPC .. G03G 15/11; G03G 15/163; G03G 21/0088; G03G 2215/0658; B41J 2/0057; B41J 2/215
See application file for complete search history.

(56) References Cited

U.S. PATENT DOCUMENTS

| | | | | |
|---|---|---|---|---|
| 8,801,171 | B2 | 8/2014 | DiRubio et al. | |
| 9,409,384 | B2 * | 8/2016 | Gila | B41J 2/0057 |
| 9,440,453 | B2 | 9/2016 | Cohen et al. | |
| 9,539,822 | B2 | 1/2017 | Bhattacharyya et al. | |
| 9,714,358 | B2 | 7/2017 | Ron et al. | |
| 2003/0067528 | A1 | 4/2003 | Chowdry et al. | |
| 2006/0284951 | A1 | 12/2006 | Ikeda et al. | |
| 2008/0055381 | A1 | 3/2008 | Doi et al. | |
| 2009/0203834 | A1 | 8/2009 | Hiraoka et al. | |
| 2010/0073448 | A1 | 3/2010 | Ikuno et al. | |
| 2011/0058001 | A1 | 3/2011 | Gila et al. | |
| 2014/0125747 | A1 | 5/2014 | Gila et al. | |
| 2018/0134031 | A1 | 5/2018 | Shmaiser et al. | |
| 2021/0162772 | A1 * | 6/2021 | Gila | C09D 11/02 |
| 2021/0240111 | A1 * | 8/2021 | Leoni | G03G 9/18 |
| 2022/0024222 | A1 * | 1/2022 | Kelekar | B41J 2/4155 |

FOREIGN PATENT DOCUMENTS

| | | | | |
|---|---|---|---|---|
| JP | 2012126008 | A | 7/2012 | |
| TW | 200611087 | A | 4/2006 | |
| WO | WO-2018007038 | A1 * | 1/2018 | B41J 3/40733 |

* cited by examiner

IMAGE FORMATION WITH IMAGE-RECEIVING HOLDER AND IMAGE FORMATION MEDIUM

BACKGROUND

Modern printing techniques involve a wide variety of media, whether rigid or flexible, and for a wide range of purposes.

DETAILED DESCRIPTION

Figures 1A, 1B:
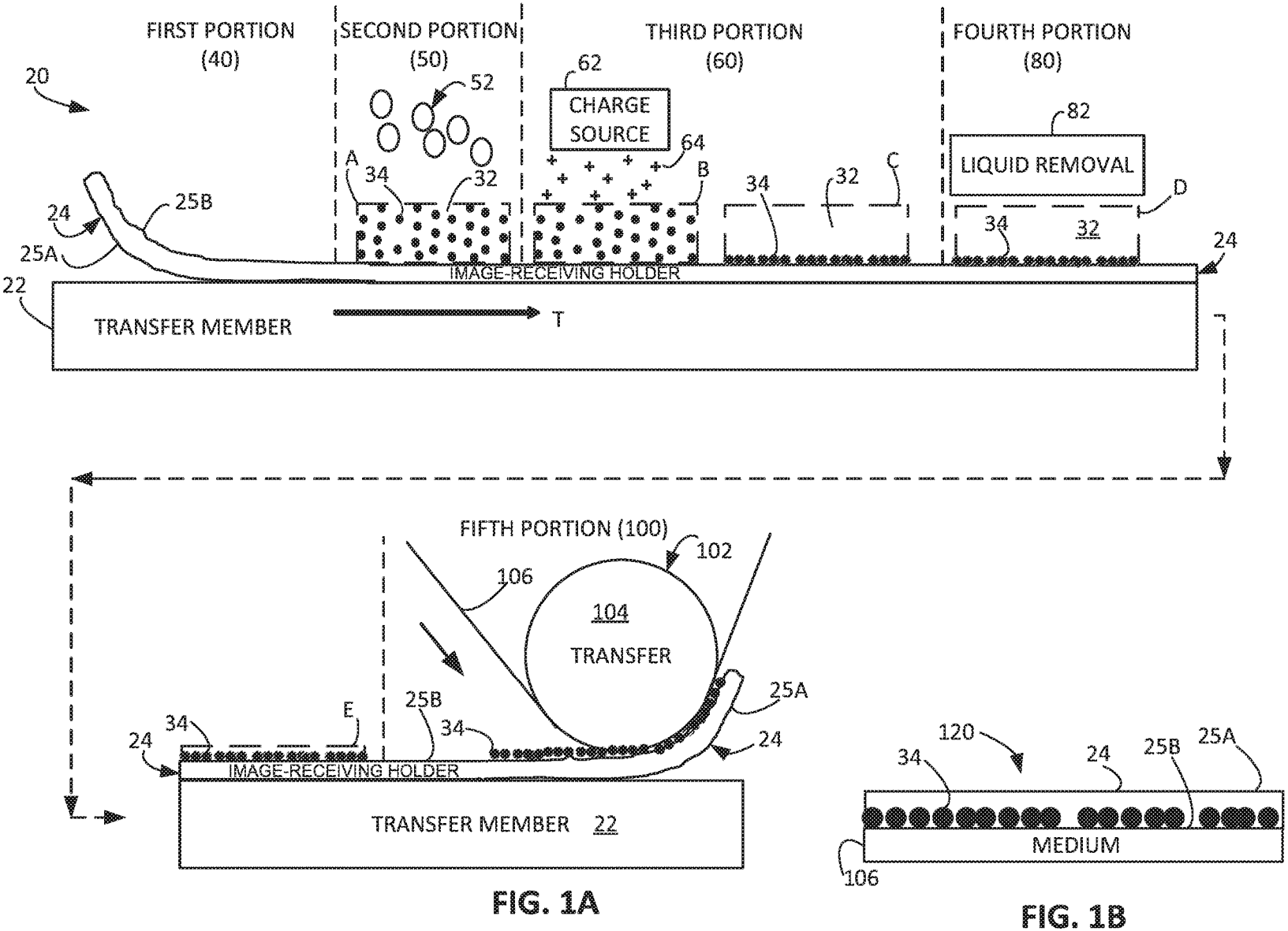
FIG. 1A is a diagram including a side view schematically representing an example image formation device and/or example method.
FIG. 1B is a side view schematically representing a portion of an example image formation medium assembly.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

At least some examples of the present disclosure are directed to application of an electrically charged, semi-liquid image-receiving holder onto a transfer member in order to receive a pattern of ejected color ink particles to form an image and to transfer both the formed ink image and the image-receiving holder onto an image formation medium (i.e. print medium). Via at least some examples of this arrangement, significantly higher quality image formation may be achieved while significantly reducing the cost, space, time to perform the image formation.

In some examples, an image formation device comprises a transfer member, a first portion, a second portion, a third portion. The transfer member is to be moved along a travel path in which the first portion along the travel path is to receive a coating layer of electrically charged, semi-liquid image-receiving material (i.e. an image-receiving holder) onto the transfer member. The second portion along the travel path is to receive a pattern of droplets of ink particles within a dielectric carrier fluid onto the image-receiving holder (on the transfer member) to form at least a portion of an image on the image-receiving holder. The third portion is downstream along the travel path from the second portion and includes a charge source to emit airborne charges to charge the ink particles to move, via electrostatic attraction relative to the transfer member and relative to the electrically charged, image-receiving holder. The charged ink particles move through the carrier fluid toward the transfer member to become electrostatically fixed on the image-receiving holder.

In some examples, the image formation device may sometimes be referred to as a printer or printing device, image formation press, web press, or digital press.

In some examples, the first portion of the image formation device comprises a first receiving portion to receive a developer unit, which is to deliver the electrostatically charged, semi-liquid image-receiving holder onto the transfer member. In some examples, the image-receiving holder may sometimes be referred to as an image receiver or an image holder. In some examples, the image-receiving holder may sometimes be referred to as an initial image formation medium (i.e. initial print medium) because the image is formed on, and remains on, the image-receiving holder. Meanwhile, the "medium" to which the ink particles and the image-receiving holder are transferred together (via a transfer station) may sometimes be referred to as a second image formation medium (i.e. second print medium) or a final image formation medium (i.e. final print medium). In some examples, the initial image formation medium and the final image formation medium may sometimes be referred to as a first image formation medium and a second image formation medium, respectively. In some such examples, the second or final image formation medium is part of an image formation medium assembly in which the image made of a pattern(s) of ink particles is sandwiched between the initial (or first) image formation medium (e.g. image-receiving holder) and the final (or second) image formation medium. In some such examples, the image formed of a pattern(s) of ink particles becomes at least partially sandwiched between the first and second image formation mediums with some portions of the respective first and second image formation mediums being in direct contact with each other.

In some examples, the second image formation medium may sometimes be referred to as a cover layer or outer layer relative to the ink particles and relative to the first image formation medium (i.e. image-receiving holder).

In some examples, the image-receiving holder may sometimes be referred to as an image-receiving medium. In some examples, the semi-liquid image-receiving holder may sometimes be referred to as a paste, a semi-liquid base, semi-solid base, or base layer.

In some examples, the image-receiving holder is colorless and/or transparent. Moreover, in at least some examples, the image-receiving holder is not applied in a particular pattern which would form an image. Accordingly, via at least some such examples, the image-receiving holder may sometimes also be referred to as a background or base for an image, much like a blank canvas or slate upon which an image may be formed.

In some examples, the second portion of the image formation device comprises a second receiving portion to receive a fluid ejection device, which is to deliver a pattern or patterns of droplets of Ink particles within a dielectric carrier fluid onto the electrically charged, image-receiving holder (as carried on the transfer member) to form at least a portion of an image on the electrically charged, image-receiving holder.

In some examples, both the developer unit and the fluid ejection device are removably received by their respective receiving portions while in some examples, just one of the developer unit and the fluid ejection device are removably received by a respective receiving portion.

In some examples, the fluid ejection device may comprise a drop-on-demand fluid ejection device to eject the pattern(s) of droplets of ink particles (within the carrier fluid) onto the electrically charged, image-receiving holder as carried on the transfer member. In some examples, the fluid ejection device comprises an inkjet printhead. In some examples, the inkjet printhead comprises a piezoelectric inkjet printhead. In some examples, the inkjet may comprise a thermal inkjet printhead. In some examples, the droplets may sometimes be referred to as being jetted onto the electrically charged, image-receiving holder.

In some examples, the fluid ejection device is to deposit the dielectric carrier fluid as a non-aqueous fluid on the image-receiving holder. In some examples, the non-aqueous fluid comprises an isoparrafinic fluid or other oil-based liquid suitable for use as a dielectric carrier fluid, as further described below. In some examples, the dielectric carrier fluid of the ejected droplets may be free of (i.e. omit) binder materials and therefore may sometimes be referred to as being binder-free, or substantially binder-free. In some examples, the dielectric carrier fluid of the ejected droplets may be free of (i.e. omit) charge directors and therefore the droplets may sometimes be referred to as being charge-director-free or substantially charge-director-free.

These examples, and additional examples, will be further described below in association with at least FIGS. 1A-11.

FIG. 1A is a diagram including a side view schematically representing an example image formation device 20. It will be further understood that FIG. 1A also may be viewed as schematically representing at least some aspects of an example method of image formation.

As shown in FIG. 1A, in some examples the image formation device 20 comprises a transfer member 22, a first portion 40, second portion 50, third portion 60, fourth portion 80, and fifth portion 100, each of which will be described below in further detail. Operation of the image formation device 20 results in an image formation medium assembly 120 (e.g. print medium assembly) as shown in FIG. 1B and which comprises an image-receiving holder 24 covering and bonding an image formed via ink particles 34 on an image formation medium 106 (i.e. print medium). As apparent from FIG. 1B, in at least some examples of image formation medium assembly 120, at least some portions of the image-receiving holder 24 may be in contact with the image formation image formation medium 106.

As shown in FIG. 1A, the transfer member 22 moves along a travel path T. In some examples, the transfer member 22 comprises an electrically conductive member, among other layers. In some examples, the transfer member may be referred to as a blanket. In some examples, the electrically conductive portion of the transfer member 22 may be in contact with an electrically conductive ground element such as a brush, roller or plate in rolling or slidable contact, respectively, with a portion of the transfer member 22. In some examples, the ground element is in contact with an edge or end of the transfer member 22. At least one example implementation of the transfer member 22, and an associated ground element, is described later in association with at least FIG. 2B.

Figure 7:
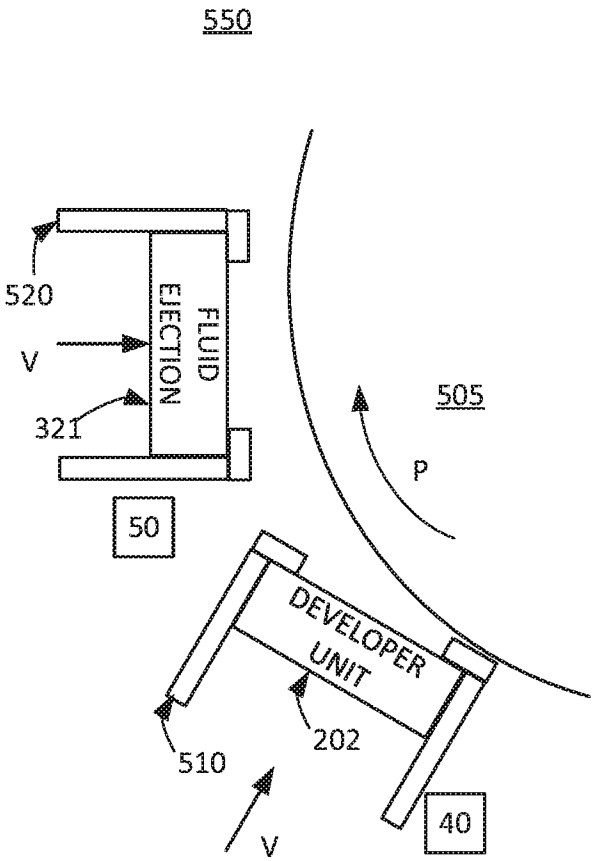
FIG. 7 is a diagram including a partial side view schematically representing removable insertion of a developer unit and of a fluid ejection device into respective receiving portions of an example image formation device.
Figure 6:
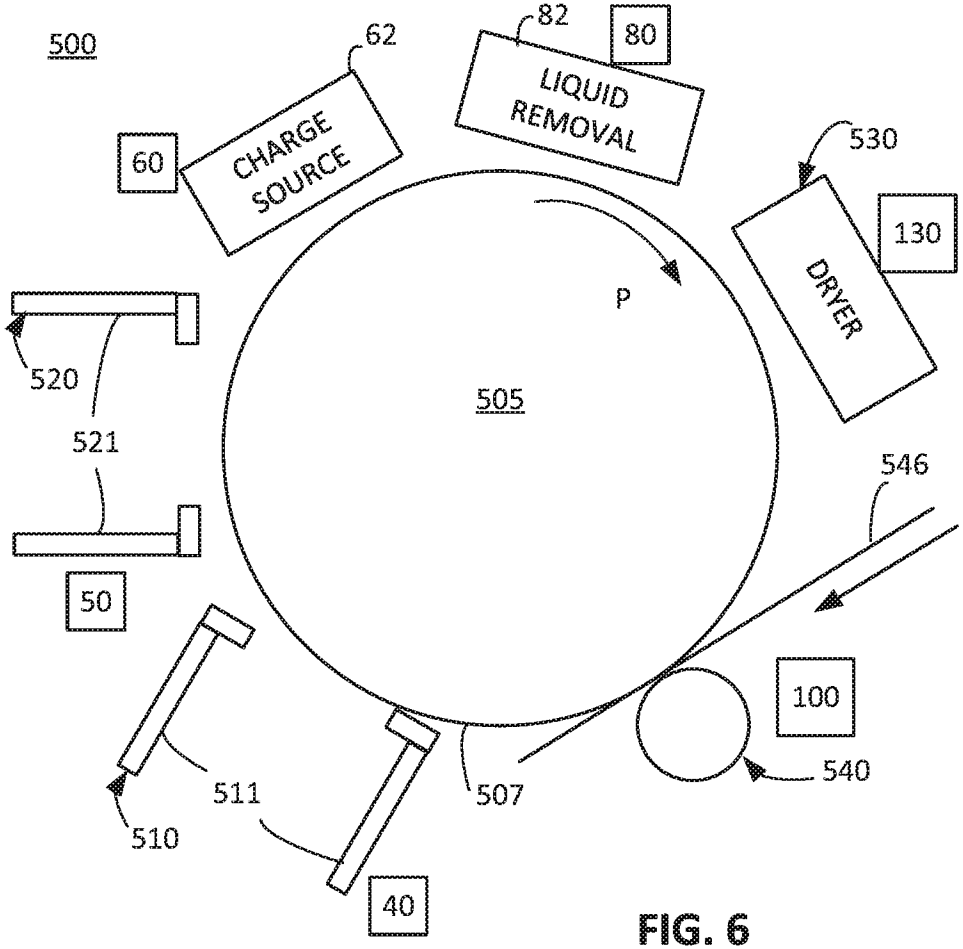
FIG. 6 is a diagram including a side view schematically representing an example image formation device including a transfer drum and/or example method.

In some examples, transfer member 22 may implemented on, or as part of, an endless belt or web (e.g. 611 in FIG. 8) while in some examples transfer member 22 may be implemented on, or as part of, a rotating drum (e.g. 505 in FIGS. 6-7). When implemented as an endless belt or web, it will be understood that the transfer member 22 may be moved along travel path T via support from an array of rollers (e.g. 610 in FIG. 8), tensioners, and related mechanisms to maintain tension and provide direction to transfer member 22 along travel path T.

As further shown in FIG. 1A, in some examples the first portion 40 of image formation device 20 is to receive a coating of electrically charged, semi-liquid material on the transfer member 22 to form an image-receiving holder 24. During such coating, the electrically charged, image-receiving holder 24 becomes releasably, electrostatically fixed as a layer relative to the transfer member 22. In this arrangement, a first surface 25A (i.e. side) of the image-receiving holder 24 faces the transfer member 22 while an opposite second surface 25B of the image-receiving holder 24 faces away from transfer member 22.

Figure 2B:
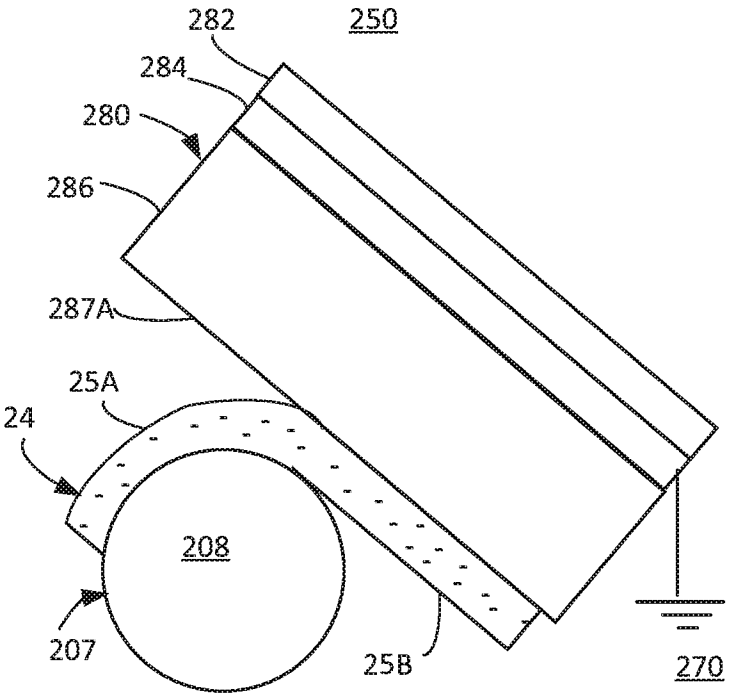
FIG. 2B is an enlarged side view schematically representing a portion of an example developer unit and example transfer member of an example image formation device.
Figure 2A:
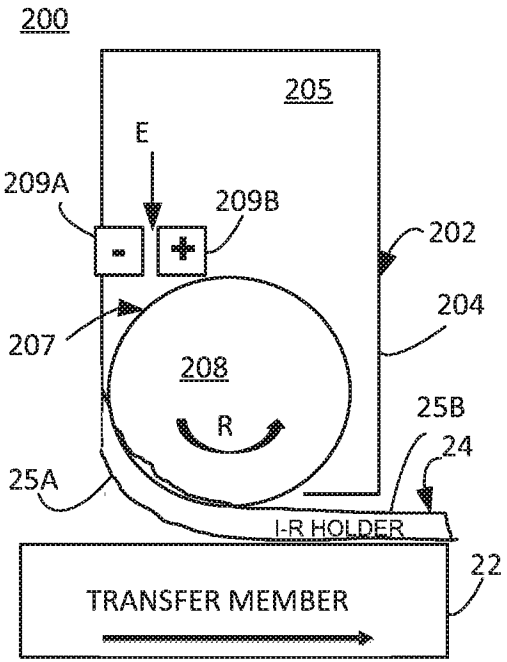
FIG. 2A is a side view schematically representing an example developer unit of an example image formation device.

In some examples, the first portion 40 of image formation device 20 comprises a developer unit to produce and apply the above-described coating of electrically charged, semi-liquid image-receiving holder 24 onto transfer member 22. FIG. 2A provides a diagram 200 schematically representing one example developer unit 202. In some examples, the developer unit 202 may comprise at least some of substantially the same features and attributes as a developer unit as would be implemented in a liquid electrophotographic (LEP) printer, such as but not limited to, an Indigo brand liquid electrophotographic printer sold by HP, Inc. In some examples, the developer unit 202 may comprise at least some of the features of a binary developer (BID) unit as described in Nelson et al. US20180231922.

As shown in FIG. 2A, in some examples, the developer unit 202 comprises a container 204 for holding various materials 205 (e.g. liquids and/or solids) which are developed into the layer 24 forming the image-receiving holder. In some examples, the materials 205 may comprise binding materials, such as resins, binding polymers (dissolved or as particles), as well as materials such as (but not limited to) dispersants, charge directors, mineral oils, foam depressing agents, UV absorbers, cross linking initiators and components, heavy oils, blanket release promoters, and/or scratch resistance additives. In one aspect, the materials 205 in any given formulation of the image-receiving holder 24 are combined in a manner such that materials 205 will be flowable in order to enable formation of image-receiving holder 24 as a layer on transfer member 22. In some examples, a mineral oil portion of the materials 205 is more than 50% by weight of all the materials 205. In some such examples, the mineral oil portion may comprise an isoparrafinic fluid, which may be sold under the trade name ISOPAR.

In some examples, the container 204 of developer unit 202 may comprise individual reservoirs, valves, inlets, outlets, etc. for separating holding at least some of the materials 205 and then mixing them into a desired paste material to form image-receiving holder 24 as a layer on transfer member 22. In some examples, the developed paste which forms image-receiving holder 24 may comprise at least about 20 percent to about 30 percent solids, which may comprise resin and/or other binder components and may comprise at least charge director additives along with the binder materials. In some such examples, the solids and charge director additives are provided within a dielectric carrier fluid, such as but not limited to, a non-aqueous fluid. In some examples, the non-aqueous liquid may comprise an isoparrafinic fluid, which may be sold under the trade name ISOPAR. As noted above, in some such examples the carrier fluid comprises more than 50% by weight of all of the materials 205 from which the paste is developed. In some examples, solid particles within the paste have a largest dimension (e.g. length, diameter) on the order of about 1 or about 2 microns.

In some examples, the charge director additives in the materials 205 may comprise a negative charge director (CD) or a synthetic charge director (SCD). In one example, the charge director can be an NCD comprising a mixture of charging components. In another example, the NCD can comprise at least one of the following: zwitterionic material, such as soya lecithin; basic barium petronate (BBP); calcium petronate; isopropyl amine dodecylebezene sulfonic acid; etc. In one specific non-limiting example, the NCD can comprise soya lecithin at 6.6% w/w, BBP at 9.8% w/w, isopropyl amine dodecylebezene sulfonic acid at 3.6% w/w and about 80% w/w isoparaffin (Isopar®-L from Exxon). Additionally, the NCD can comprise any ionic surfactant and/or electron carrier dissolved material. In one example, the charge director can be a synthetic charge director. The charge director can also include aluminum tri-stearate, barium stearate, chromium stearate, magnesium octoate, iron naphthenate, zinc napththenate, and mixtures thereof.

As further shown in FIG. 2A, the developer unit 202 comprises a roller assembly 207 disposed at least partially within container 204 and selectively exposed to the paste of materials 205 being developed. The roller assembly 207 comprises a developer drum 208, which is driven to a negative voltage (e.g. −500 V) for electrostatically charging the paste of materials 205 and electrostatically delivering the charged paste of materials 205 as layer 24 on the transfer member 22, as shown in FIG. 2B. In one such example, the paste of materials 205 is negatively charged. In some examples, the charge director additives receive and hold the negative charge in a manner to thereby negatively charge at least the binder materials within the paste of materials 205 when an electrical field is applied to the paste of materials 205, such as via the development roller 208 at −500 Volts. Via such example arrangements, the image-receiving holder 24 may sometimes be referred to as an electrically charged, image-receiving holder.

In some examples, the developer drum or roller 208 may comprise a conductive polymer, such as but not limited to polyurethane or may comprise a metal material, such as but not limited to, Aluminum or stainless steel.

In some examples, the materials 205 may start out within the container 204 (among various reservoirs, supplies) with about 3 percent solids among various liquids, and via a combination of electrodes (e.g. at least 209A, 209B in FIG. 2A) "squeeze" the formulation into a paste of at least about 20 percent solids, as noted above. As shown in at least FIG. 2B, the paste of materials 205 is applied as a layer (onto transfer member 22) having a thickness of about 4 to about 8 microns, in at least some examples. It will be understood that the volume and/or thickness of the layer (forming image-receiving holder 24) that is transferred from the developer unit 202 to the transfer member 22 may be controlled based on a voltage (e.g. −500V) of the developer roller 208 and/or a charge level of the solid particles within the paste produced by the developer unit 202.

Accordingly, via such example arrangements, upon rotation of at least drum 208 of the roller assembly 207, and other manipulations associated with container 205, the drum 208 electrostatically attracts some of the charged developed material 205 to form the layer forming image-receiving holder 24, which is then deposited onto transfer member 22 as shown in FIG. 2A.

In some examples the transfer member 22 may comprise a transfer member 280. In some such examples, the transfer member 280 comprises an outer layer 286, an electrically conductive layer 284, and a backing layer 282. The transfer member 280 comprises at least some electrically conductive material (e.g. layer 284) which may facilitate attracting the negatively charged paste of materials 205 to complete formation of the image-receiving holder 24 as a layer on a surface 287A of an outer layer 286 of the transfer member 280, as shown in FIG. 2B.

In some such examples, the outer layer 286 of transfer member 280 may comprise a layer which is compliant at least with respect to a particular media onto which the formed image will be transferred. In some examples, the outer layer 286 may comprise a silicone rubber layer and is made of a flexible, resilient material. In some such examples, the electrical conductivity of outer layer 286 may be in the range of about $10^4$ Ohm-cm to about $10^7$ Ohm-cm, although in some examples, the electrical conductivity may extend outside this range. The electrical properties of layer 286 can be optimized with regards to voltage drop, charge conductivity across the layer, response time, and arcing risks.

In some examples, the electrically conductive layer 284 of transfer member 280 may comprise of a conductive rubber like silicone, a conductive plastic like polyvinyl chloride (PVC), or a polycarbonate which typically is doped with carbon pigments to become conductive. In some examples, the electrically conductive layer 284 may comprise other conductive inks, adhesives, or curable conductive paste could also be used as well as metalized layer. In some examples, the electrically conductive layer 284 may comprise a sheet resistance of less than 100 ohm/sq and be made from materials which are more conductive than 0.1 Ohm-cm.

As shown in FIG. 2B, in some examples the electrically conductive layer 284 is electrically connected to an electrical ground 270.

In some examples, the transfer member 280 also comprises a backing layer 282, which in some examples may comprise a fabric, polyamide material, and the like in order to provide some stiffness to the transfer member 280, among other functions. In some examples, the compliant layer 286 may comprise a thickness of about 100 microns while the electrically conductive layer 284 may comprise a thickness on the order of a few microns.

In some examples, the transfer member 280 may comprise a release layer of a few microns thickness on top of the outer layer 286 in order to facilitate release of the image-receiving holder 24 (with an image formed via ink particles thereon) from the transfer member 280 at a later point in time, such as at a transfer station (e.g. 102 in FIG. 1A).

In some examples, the developer unit 202 may comprise a permanent component of image formation device 20, with the developer unit 202 being sold, shipped, and/or supplied, etc. as part of image formation device 20. It will be understood that such "permanent" components may be removed for repair, upgrade, etc. as appropriate.

As further described later in association with at least FIGS. 6-7, in some examples the first portion 40 of image formation device 20 may comprise a first receiving portion 510 to removably receive a developer unit (e.g. 202 in FIG. 2A), such as in some examples in which the developer unit 202 is removably insertable into a first receiving portion 510, as shown in at least FIGS. 6-7. The first receiving portion 510 is sized, shaped, and positioned relative to transfer member (e.g. 505 in FIGS. 6-7), as well as relative to other components of image formation device 20, such that upon removable insertion into to first receiving portion 510 (as represented by arrow V in FIG. 7), the developer unit 202 is positioned to deliver the image-receiving holder 24 onto transfer member 505, in a manner similar to that shown in FIGS. 1A, 2A. In some such examples, the developer unit 202 may comprise a consumable which is periodically replaceable due to wear, exhaustion of a supply of ink-binder material, developer components, etc. In some such examples, the developer unit 202 may be sold, supplied, shipped, etc. separately from the rest of image formation device 20 (or 500 in FIG. 6, 600 in FIG. 8) and then installed into the respective image formation device (e.g. 20, 500, 600) upon preparation for use of the image formation device at a particular location. The first receiving portion 510 in FIGS. 6-7 may sometimes be referred to as a first receptor. Accordingly, it will be apparent that in some examples the first receiving portion 510 may comprise part of the first portion 40 of image formation device 20 in FIG. 1A or part of first portion 40 in image formation device 600 in FIG. 8.

In some examples the first portion 40 of the example image formation device 20 involves developing the image-receiving holder 24 without any color pigments in the image-receiving holder 24, such that the image-receiving holder 24 may sometimes be referred to as being colorless. In this arrangement, in some examples the image-receiving holder 24 corresponds to a liquid-based ink formulation which comprises at least substantially the same components as used in liquid electrophotographic (LEP) process, except for omitting the color pigments. In addition to being colorless in some examples, the ink-binder material also may be transparent and/or translucent upon application to an image formation medium or to a transfer member 22.

In some examples, the image-receiving holder 24 may comprise some color pigments so as to provide a tint. In some such examples, such color pigments may be transparent or translucent as well so as to not interfere with, or otherwise, affect the formation or appearance of an image via the ink particles 34 deposited in second portion 50, such as via a fluid ejection device (e.g. 321 in FIG. 3).

In at least some examples in which the image-receiving holder 24 omits color pigments, the materials of the image-receiving holder 24 effectively do not comprise part of the image resulting from the deposited color ink particles which will be later transferred (with the image-receiving holder 24) onto an image formation medium. Accordingly, in some such examples the image-receiving holder 24 also may sometimes be referred to as a non-imaging, image-receiving holder 24.

In some such examples, the image-receiving holder 24 comprises all (e.g. 100 percent) of the binder used to hold an image (formed of and including ink particles 34) on transfer member 22 and later on an image formation print medium. In some such examples, image-receiving holder 24 comprises at least substantially all (e.g. substantially the entire volume) of the binder used to hold the image (including ink particles). In some such examples, in this context the term "at least substantially all" (or at least substantially the entire) comprises at least 95%. In some such examples "at least substantially all" (or at least substantially the entire) comprises at least 98%. In some examples in which the image-receiving holder 24 may comprise less than 100 percent of the binder used to hold the image on the transfer member 22 (and later on an image formation medium), with the remaining desired amount of binder being provided from droplets 52 delivered in the first portion 40 of image formation device 20. It will be understood that the term binder may encompass resin, binder materials, and/or polymers, and the like to complete image formation with the ink particles 34.

As further noted below, formulating the image-receiving holder 24 to comprise at least substantially all of the binder material(s) to be used to hold the image relative to the transfer member 22 (and later on an image formation medium) acts to free the second portion 50 (and fluid ejection device 321) so that, in at least some examples, the droplets (e.g. 52 in FIG. 1, 322 in FIG. 3) may omit any binder material, and therefore be "binder-free." Accordingly, in some examples, the droplets 52 may sometimes be referred to as being binder-free droplets.

In some examples, the droplets 52 omit charge director additives and therefore may sometimes be referred to as being charge-director-free. In some such examples, the image-receiving holder 24 may comprise some charge-director additives as further described with respect to developer unit 202 (FIG. 2A-2B).

This example arrangement of supplying all or substantially all of the binder (for forming the image) via the image-receiving holder 24 may help to operate a fluid ejection device (e.g. 321 in FIG. 3, 6-7) with fewer maintenance issues because the absence (or nearly complete absence) of a binder in the droplets 52 may avoid fouling the ejection elements, which may sometimes occur with droplets 52 including binder material for forming an image on an image formation medium. In addition to simplifying maintenance, this arrangement may increase a longevity of the ejection elements (e.g. printhead) of the fluid ejection device 321.

In some examples, the developer unit 202 is to apply the image-receiving holder 24 in a volume to cover at least substantially the entire surface of the transfer member 22 in at least the area in which the image is be formed on transfer member 22 and immediately surrounding regions. In some examples, in this context, the term "substantially the entire" comprises at least 95 percent, while in some examples, the term "substantially the entire" comprises at least 99 percent.

In some examples, the image-receiving holder 24 is applied to form a uniform layer covering an entire surface of the transfer member 22 (at least including the area in which an image is to be formed). This arrangement stands in sharp contrast to some liquid electrophotographic printers in which liquid ink (with color pigments) is applied just to areas of a charged photo imaging plate (PIP), which have been discharged in a pattern according to the image to be formed. According, the application of a uniform layer (covering an entire surface of the transfer member 22) of the image-receiving holder in the example image formation device 20 bears no particular relationship to the pattern of an image to be formed on the image-receiving holder 24. Therefore, in some instances, the image-receiving holder 24 may sometimes be referred to as a non-imaging, image-receiving holder 24.

Moreover, in another aspect, coating image-receiving holder 24 on transfer member 22 may effectively eliminate "image memory" which otherwise may sometimes occur when forming ink images directly on a transfer member 22. In addition, the coating of image-receiving holder 24 on the transfer member 22 may protect the transfer member 22 from dust from a print medium (e.g. paper dust) and/or from plasma associated with production of charges 64 via the charge source 62, as further described later. Among other aspects, this arrangement may increase a longevity of the transfer member 22. In some examples, the employment of the image-receiving holder 24 to receive and transfer an image (made of ink particles 34) may substantially increase the longevity of the transfer member 22. In some examples, in this context the term "substantially increase" may correspond to an increase in longevity of at least 25%, at least 50%, or at least 75%. In some examples, in this context the term "substantially increase" may correspond to an increase in longevity of at least 2×, at least 3×, or at least 5×.

Figure 8:
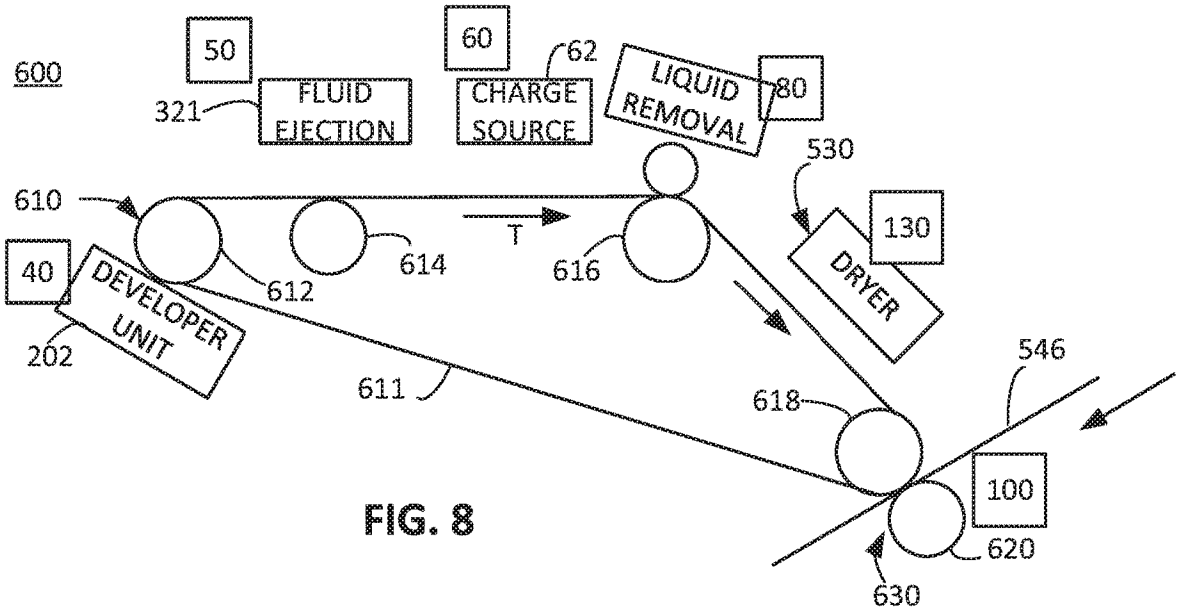
FIG. 8 is a diagram including a side view schematically representing an example image formation device including an endless transfer belt and/or example method.

It will be understood that the developer unit 202 (which may be permanent or may be removably insertable into first receiving portion 510) may be implemented in an image formation device whether the transfer member 22 is in the form drum as shown in FIGS. 6-7 or in the form of a belt as shown in FIG. 8.

As shown in FIG. 1A, in some examples the second portion 50 of image formation device 20 is located downstream from the first portion 40 along the travel path T, and is to receive droplets 52 of ink particles 34 within a dielectric carrier fluid 32 on the image-receiving holder 24 (as carried by transfer member 22). The depiction within the dashed lines A in FIG. 1A represents ink particles 34 and carrier fluid 32 after being received on the image-receiving holder 24 (on transfer member 22) to form at least a portion of an image on the image-receiving holder 24. In some examples, the droplets 52 from which ink particles 34 are formed may comprise pigments, dispersants, the carrier fluid 32, etc. In some examples, the droplets 52 may comprise at least some binder materials. However, in at least some examples, the droplets 52 omit binder materials (e.g. resin, binding polymers, etc.), which are instead supplied via the image-receiving holder 24. Further details regarding droplets 52 are described below in association with at least FIG. 3.

Figure 3:
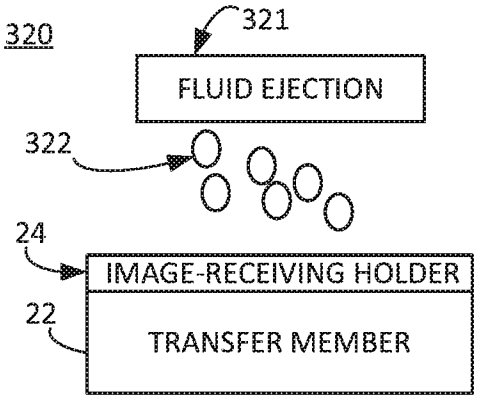
FIG. 3 is a side view schematically representing an example fluid ejection device of an example image formation device.

As previously noted, in some examples the second portion 50 of the image formation device 20 may comprise a fluid ejection device. FIG. 3 is a diagram 320 including a side view schematically representing an example fluid ejection device 321 which may be implemented as part of the second portion 50, in some examples. As shown in FIG. 3, fluid ejection device 321 is positionable at a location spaced apart and above the transfer member 22 (and image-receiving holder 24 thereon). In some examples, the fluid ejection device 321 comprises a drop-on-demand fluid ejection device. In some examples, the drop-on-demand fluid ejection device comprises an inkjet printhead. In some examples, the inkjet printhead comprises a piezoelectric inkjet printhead while in some examples, the inkjet printhead comprises a thermal inkjet printhead. In some examples, the fluid ejection device 321 may comprise other types of inkjet printheads.

In some examples, as further described later in association with at least FIG. 10A, among directing other and/or additional operations, a control portion 800 is instruct, or to cause, the fluid ejection device 321 to deliver the droplets 322 (e.g. 52 in FIG. 1A) of ink particles 34 within the dielectric carrier fluid 32 onto the image-receiving holder 24 on transfer member 22, such as within the second portion 50 along the travel path T of image-receiving holder 24 (on the transfer member 22).

In some examples, the fluid ejection device 321 may comprise a permanent component of image formation device 20, with the fluid ejection device 321 being sold, shipped, and/or supplied, etc. as part of image formation device 20. It will be understood that such "permanent" components may be removed for repair, upgrade, etc. as appropriate.

As further described later in association with at least FIG. 6, in some examples the second portion 50 of image formation device 20 may comprise a second receiving portion 520 to removably receive a fluid ejection device (e.g. 321 in FIG. 3), such as in some examples in which the fluid ejection device 321 is removably insertable into the second receiving portion 520, as shown in at least FIG. 7. The second receiving portion 520 is sized, shaped, and positioned relative to transfer member (e.g. 505 in FIGS. 6-7), as well as relative to other components of image formation device 20, such that upon removable insertion relative to second receiving portion 520 (as represented by arrow V in FIG. 7), the fluid ejection device 321 is positioned to deliver (e.g. eject) the droplets 322 of ink particles 34 and dielectric carrier fluid 32 on the image-receiving holder 24 carried by transfer member 22, in a manner similar to that shown in FIG. 1A.

In some such examples, the fluid ejection device 321 may comprise a consumable which is periodically replaceable due to wear, exhaustion of an ink supply, etc. In some such examples, the fluid ejection device 321 may be sold, supplied, shipped, etc. separately from the rest of image formation device 20 (or 500 in FIG. 6, 600 in FIG. 8) and then installed into the respective image formation device (e.g. 20, 500, 600) upon preparation for use of the image formation device at a particular location. The second receiving portion 520 may sometimes be referred to as a second receptor. In some examples, the second receiving portion 520 may comprise supports 521.

It will be understood that the second receiving portion 520 may be implemented in a second portion 50 of an image formation device whether the transfer member 22 is in the form drum as shown in FIGS. 6-7 or in the form of a belt as shown in FIG. 8.

With further reference to at least FIGS. 1A, 3, 6-8, in some examples, as part of ejecting droplets (e.g. 52 in FIG. 2, 322 in FIG. 3, etc.), the fluid ejection device (e.g. 321 in FIG. 3) is to deposit the dielectric carrier fluid 32 on the image-receiving holder 24 as a non-aqueous liquid. In some examples, the non-aqueous liquid comprises an isoparrafinic fluid, which may be sold under the trade name ISOPAR. In some such examples, the non-aqueous liquid may comprise other oil-based liquids suitable for use as a dielectric carrier fluid.

As further shown in FIG. 1A, in some examples, the third portion 60 of image formation device 20 is located downstream along the travel path T from the second portion 50 and includes a charge source 62 to emit airborne charges 64 to charge the ink particles 34, as represented via the depiction in dashed lines B in FIG. 1A. Once charged, the ink particles 34 move, via attraction relative to the charged image-receiving holder 24 (and transfer member 22), through the carrier fluid 32 toward the second surface 25B of the image-receiving holder 24 to become electrostatically fixed on the image-receiving holder 24, as represented via the depiction in dashed lines C in FIG. 1A.

With further reference to FIG. 1A, in some examples the charge source 62 in the third portion 60 may comprise a corona, plasma element, or other charge generating element to generate a flow of charges 64. The generated charges may be negative or positive as desired. In some examples, the charge source 62 may comprise an ion head to produce a flow of ions as the charges. It will be understood that the term "charges" and the term "ions" may be used interchangeably to the extent that the respective "charges" or "ions" embody a negative charge or positive charge (as determined by charge source 62) which can become attached to the ink particles 34 to cause all of the charged ink particles to have a particular polarity, which will be attracted to ground. In some such examples, all or substantially all of the charged ink particles 34 will have a negative charge or alternatively all or substantially all of the charged ink particles 34 will have a positive charge. In one example, the charges 64 are positive charges as shown in FIG. 1A. While the charges 64 shown in the various examples in FIGS. 1A-12 are depicted as having a particular polarity (positive or negative), it will be understood that the polarity of charges 64 may be selected and implemented in view of the polarity of other elements of an example image formation device (or associated with an example image formation device), such as a polarity of elements (e.g. charge directors, binder particles) within the electrically charged, image-receiving holder 24. It will be understood that other elements (e.g. transfer member 22, 280) in contact with image-receiving holder 24 may exhibit, may develop, or be caused to exhibit charges having a polarity opposite from the polarity of the charges 64 (and therefore opposite from the polarity of the charged ink particles 34). Via such example arrangements of opposite polarity charges, the electrostatic attraction forces may be at least partially implemented. In some examples, the charges 64 may affect the charge level and/or the polarity of image-receiving holder 24 to keep the electrostatic attraction forces of particles 34 at least partially implemented.

Via such example arrangements, the charged ink particles 34 become electrostatically fixed on the electrically charged, image-receiving holder 24 in a location on the image-receiving holder 24 generally corresponding to the location (in an x-y orientation) at which they were initially received onto the image-receiving holder 24 in the second portion 50 of the image formation device 20. Via such electrostatic fixation, the ink particles 34 will retain their position on electrically charged, image-receiving holder 24 even when other ink particles (e.g. different colors) are added later with additional liquid, even when excess liquid is mechanically removed, etc. It will be understood that while the ink particles 34 may retain their position on image-receiving holder 24, some amount of expansion of a dot (formed of ink particles 34) may occur after the ink particles 34 (within carrier fluid 32) are jetted onto image-receiving holder 24 and before they are electrostatically pinned in their respective locations (which forms the pattern of the image). In some examples, the charge source 42 is spaced apart by a predetermined distance (e.g. downstream) from the location at which the droplets 52 are received (or ejected) in order to delay the electrostatic fixation (per operation of charge source 62), which can increase a dot size on image-receiving holder 24, which in turn may lower ink consumption.

As shown in FIG. 1A, in some examples a fourth portion 80 is located downstream along the travel path T from the third portion 60 and comprises a liquid removal element(s) 82 to at least mechanically remove excess volumes of liquid, including carrier fluid 32) which has accumulated on the image-receiving holder 24 as a result of receiving droplets 52 in the second portion 50. After the electrostatic fixation of the ink particles 34 (in the form of at least a portion of an image) as shown via the dashed box C in third portion 60 in FIG. 1A, the excess liquid is no longer useful for the current instance of image formation and therefore is removed as shown in fourth portion 80. In some examples, the collected excess liquid may be recovered and re-used in future depositions of droplets in the second portion 50 in subsequent instances of image formation via the image formation device 20 and/or re-used for other purposes.

In some examples, the first liquid removal element(s) 82 is to remove the carrier fluid 32 without heating the fluid 32 at all or without heating the carrier fluid 32 above a predetermined threshold. In some instances, such liquid removal may sometimes be referred to as cold liquid removal (e.g. cold oil removal) by which the liquid is removed at relatively cool temperatures, at least as compared to high heat drying techniques. Accordingly, in some such examples, a mechanical element (e.g. squeegee roller) of the first liquid removal element(s) 82 may slightly heat the carrier fluid 32 and/or other liquid without using heat as a primary mechanism to remove the carrier fluid 32 from the ink particles 34 on image-receiving holder 24. In some such examples, performing such cold liquid removal may substantially decrease the amount of energy used to remove deposited liquid (e.g. from the top of image-receiving holder 24) as compared to using a heated air dryer primarily or solely to remove the liquid. In some examples, in this context the term "substantially decrease" may correspond to at least 10×, at least 20×, or at least 30×. In addition, using cold oil removal via example image formation devices may significantly decrease the space or volume occupied by the example image formation device 20, thereby reducing its cost and/or cost of space in which the image formation device 20 may reside.

Figure 4:
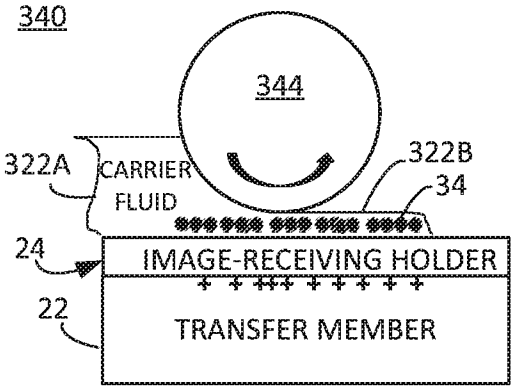
FIG. 4 is a side view schematically representing an example liquid removal device of an example image formation device.

As further shown in the diagram 340 of FIG. 4, in some examples the first liquid removal element(s) 82 may comprise a squeegee and/or roller 304 or other mechanical structure to remove the excess carrier fluid 322A (and any other liquid) from the surface of image-receiving holder 24. In some examples, the electrostatically fixed (e.g. pinned) charged ink particles 34 remain fixed in their respective locations (e.g. pattern) on image-receiving holder 24 during this mechanical removal of liquid at least because the electrostatic fixation forces are greater than the shear forces exhibited via the tool(s) used to mechanically remove the carrier fluid 32. As previously noted, after such liquid removal, in some examples a minimal amount 322B of liquid may remain with ink particles 34 on image-receiving holder 24 as shown in FIG. 4.

In the fourth portion 80, in some examples, at least 80 percent of the jetted carrier fluid 32 on image-receiving holder 24 is removed. In some examples, at least 90 percent of the jetted carrier fluid 32 is removed. In some examples, at least 95 percent of the jetted carrier fluid 32 is removed. However, in some examples, first liquid removal element(s) 82 may remove at least 50 percent of total liquid, which includes the carrier fluid 32, from image-receiving holder 24.

In some examples the image formation device 20 may further comprise a second liquid removal portion downstream from the first liquid removal element(s) 82. This second liquid removal portion may comprise part of the fourth portion 80 or comprise a sixth portion between the fourth portion 80 and fifth portion 100. This second liquid removal portion acts to remove any liquid not removed via first liquid removal element(s) 82 (in fourth portion 80) and thereby result in dried ink particles 34 on the image-receiving holder 24, as represented via the depictions in dashed lines E in FIG. 1A, or as later shown in FIG. 5. In some examples, at least some of the liquid removed via the second liquid removal portion includes some liquid (e.g. carrier fluid) from the image-receiving holder 24 such that operation of the second liquid removal portion facilitates further solidification of the image-receiving holder 24 prior to its transfer to an image formation medium (e.g. 106 in FIG. 1B).

Figure 5:
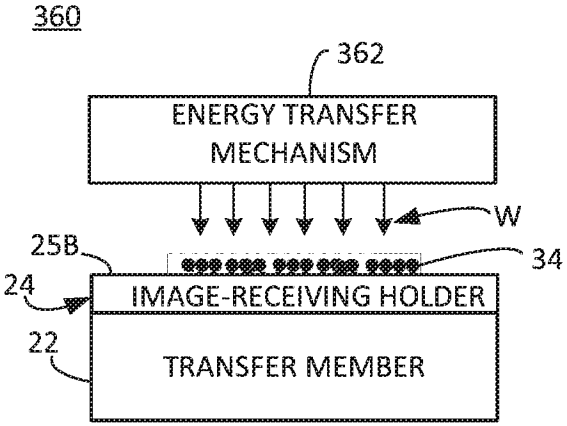
FIG. 5 is a side view schematically representing an example energy transfer mechanism of an example image formation device.

In some such examples, this second liquid removal portion may be implemented as shown in the diagram 360 of FIG. 5 as an energy transfer mechanism 362 by which energy (represented via arrows W) is transferred to the liquid 32, ink particles 34, and image-receiving holder 24 in order to dry the ink particles 34 on the image-receiving holder 24 and/or dry the image-receiving holder 24.

In some examples, the energy transfer mechanism 362 may comprise a heated air element to direct heated air (represented via W) onto at least the carrier fluid 32 and ink particles 34 on image-receiving holder 24. In some examples, the heated air is controlled to maintain the ink particles 34, image-receiving holder 24, etc. at a temperature below 60 degrees C., which may prevent irregularities in the image-receiving holder 24.

In some examples, the energy transfer mechanism 362 may comprise a radiation element to direct at least one of infrared (IR) radiation and ultraviolet (UV) radiation (as represented via arrows W) onto the liquid 32, ink particles 34, and in image-receiving holder 24 to eliminate liquid remaining after operation of the first liquid removal element(s) 82.

While at least some examples of image formation device 20 may comprise an energy transfer mechanism 362 to remove remaining amounts of liquid after liquid removal element(s) 82, it will be understood that the transmitted energy also may facilitate solidifying the binder (from image-receiving holder 24) with ink particles 34 (from droplets 52) to complete formation and solidification of the image on the image-receiving holder 24.

As further shown in FIG. 1A, in some examples image formation device 20 may further comprise a transfer station 102 (in fifth portion 100) downstream from the liquid removal element(s) 82 (in fourth portion 80). Via at least a transfer roller (e.g. drum) 104 the transfer station 102 is to transfer at least substantially the entire image-receiving holder 24 with at least substantially the entire volume of ink particles 34 thereon (in the form of an image) onto an image formation medium 106 (e.g. image formation medium). As previously noted, this complete (or nearly complete transfer) may increase image quality, protect the transfer member, etc. In addition, in this way, no residue is left remaining on the transfer member, thereby simplifying or eliminating later cleaning of the transfer member, such as between consecutive printing episodes.

In some examples, the transfer station 102 may employ heat, pressure, and/or electrical bias, etc. in order to effect the above-described transfer.

In addition, by transferring the image-receiving holder 24 with the ink particles 24 (as a pattern or form of an image), the image-receiving holder 24 becomes an outermost layer of a completed image formation medium assembly 120 shown in FIG. 1B, thereby protecting the image formed of ink particles 34 and helping bond the formed image to the image formation medium 106.

In some examples, the image-receiving holder 24 may sometimes be referred to as an image receiver or an image holder. In some examples, the image-receiving holder 24 may sometimes be referred to as an initial image formation medium (i.e. initial print medium) because the image is formed on, and remains on, the image-receiving holder. Meanwhile, the "medium" (e.g. 106 in FIGS. 1A-1B) to which the ink particles and the image-receiving holder are transferred together (via a transfer station) may sometimes be referred to as a second image formation medium (i.e. second print medium) or a final image formation medium (i.e. final print medium). In some examples, the initial image formation medium (e.g. 24 in FIG. 1A) and the final image formation medium (e.g. 106 in FIGS. 1A-1B) may sometimes be referred to as a first image formation medium and a second image formation medium, respectively. In some such examples, the second or final image formation medium is part of an image formation medium assembly (e.g. 120 in FIG. 1B) in which the image made of a pattern(s) of ink particles 34 are at least partially sandwiched between the initial (or first) image formation medium 24 (e.g. image-receiving holder) and the final (or second) image formation medium 106. In some such examples, the image formed of a pattern(s) of ink particles 34 becomes at least partially sandwiched between the first and second image formation mediums with some portions of the respective first and second image formation mediums (e.g. 24, 106) being in direct contact with each other, as shown in FIG. 1B in one example.

In some examples, the second image formation medium may sometimes be referred to as a cover layer or outer layer relative to the ink particles and relative to the first image formation medium (i.e. image-receiving holder).

In some examples, the image-receiving holder may sometimes be referred to as an image-receiving medium. In some examples, the semi-liquid image-receiving holder may sometimes be referred to as a paste, a semi-liquid base, semi-solid base, or base layer.

In transferring all or substantially all of the ink particles 34 (from their supported position relative to transfer member 22) onto an image formation medium 106, the image-receiving holder 24 facilitates additional forms of printing or image formation. In particular, because all of the ink particles 34 can be transferred, the fluid ejection device (e.g. 321) (via instructions from control portion 800) can perform stochastic-screening image formation via the ink particles 34 in which at least some of the dot sizes (made of ink particles 34) or all of the dot sizes used to form an image may be less than 50 microns on the image-receiving holder 24 (supported by the transfer member 22). In some examples, at least some of the dot sizes or all of the dot sizes may be 45 microns and/or less than 45 microns. In some examples, at least some of the dot sizes or all of the dot sizes may be 40 microns and/or less than 40 microns. In some examples, at least some of the dot sizes or all of the dot sizes may be 35 microns and/or less than 35 microns. In some examples, at least some of the dot sizes or all of the dot sizes may 30 microns and/or may be less than 30 microns. In some examples, at least some of the dot sizes or all of the dot sizes may 25 microns and/or may be less than 25 microns. In some such examples, at least some of the dot sizes or all of the dot sizes formed on the image-receiving holder 24 may be 20 microns or less than 20 microns. It will be understood that, in at least some examples, the ink particles 34 may have a largest dimension (e.g. diameter, length, etc.) less than 1 micron.

In some instances, the stochastic screening may sometimes be referred to as frequency modulation (FM) screening. In some examples, the stochastic screening may comprise printing according to a pseudo-random distribution of halftone dots in which frequency modulation (FM) is used to control the density of dots according to the gray level desired. Via such stochastic screening, the fluid ejection device (e.g. 321 in FIG. 3) deposits a fixed size of dots (e.g. on the order of 20 microns) and implements a distribution density that varies depending on the color's tone. In contrast, in amplitude modulation (AM) halftone printing the printed dots may vary in size depending on the color tone being represented, while maintaining a geometric and fixed spacing of the dots. However, in amplitude modulation halftone printing the minimum size of the printed dots is substantially greater (e.g. 50%, 75%, 100%) greater than a size of dots printable via stochastic screening, such as available via the example image formation device 20.

Via stochastic screening in some examples, the example image formation device 20 may produce higher resolution images on a print medium, a greater color gamut, among other aspects.

It will be understood that in some examples, the sequence of operation of some portions of image formation device 20 may be re-arranged in some instances. Moreover, it will be understood that in some examples the labeling of the various portions as first, second, third, fourth, fifth portions (e.g. 40, 60, 80, 100, etc.) does not necessarily reflect an absolute ordering or position of the respective portions along the travel path T. Moreover, such labeling of different portions also does not necessarily represent the existence of structural barriers or separation elements between adjacent portions of the image formation device 20. Furthermore, in some examples, the components of the image formation device 20 may be organized into a fewer or greater number of portions than represented in FIG. 1A.

FIG. 6 is a diagram including a side view schematically representing at least a portion of an example image formation device 500. In some examples, image formation device 500 comprises at least some of substantially the same features as image formation device 20 as previously described in association with FIGS. 1A-5, except with transfer member 22 arranged in the form of, or as part of, a drum 505 and with the various portions 40, 50, 60, 80, 100, etc. arranged in a circumferential pattern about drum 505 as shown in FIGS. 6-7. For illustrative simplicity, the various portions 40, 50, 60, 80, 100 of image formation device 500 are represented via boxes instead of dashed lines as in FIG. 1A and FIG. 9.

As shown in FIG. 6, first portion 40 comprises the previously identified first receiving portion 510 to removably receive a developer unit, such as developer unit 202 which is removably insertable into the first receiving portion 510 as shown in FIG. 7. In some examples, the first receiving portion 510 may comprise supports 511. In some examples, the developer unit 202 may comprise at least some of substantially the same features and attributes as developer unit 202 of FIGS. 2A-2B. As in FIGS. 1-2B, the developer unit 202 develops and electrostatically deposits an image-receiving holder 24 onto an outer surface 507 of drum 505 to receive droplets of ink, etc.

In some examples, as further described later in association with at least FIG. 10A, among directing other and/or additional operations, a control portion 800 is instruct, or to cause, the developer unit 202 to deliver the image-receiving holder 24 onto transfer member 505, such as within the first portion 40 along the travel path T of transfer member 505 in FIG. 6.

As shown in FIG. 6, second portion 50 is downstream from first portion 40 (given a rotational direction P of drum 505) and in some examples may comprises the previously identified second receiving portion 520 to removably receive a fluid ejection device, such as fluid ejection device 321 which is removably insertable into the second receiving portion 520 as shown in FIG. 7. In some examples, the fluid ejection device 321 may comprise at least some of substantially the same features and attributes as fluid ejection device 321 of FIG. 3. As in FIG. 3, the fluid ejection device 321 when deployed in image formation device 500 in FIGS. 6-7 is to deposit droplets 322 (e.g. 52 in FIG. 1A) of ink particles 34 within a dielectric carrier fluid 32 onto an image-receiving holder 24 supported on the outer surface 507 of drum 505.

In some examples, as further described later in association with at least FIG. 10A, among directing other and/or additional operations, a control portion 800 is instruct, or to cause, the fluid ejection device 321 to deliver the droplets 322 (e.g. 52 in FIG. 1A) onto the image-receiving holder 24 on transfer member 505, such as within the first portion 40 along the travel path T of transfer member 505 in FIG. 6.

As further shown in FIG. 6, in some examples the image formation device 500 may comprise a fifth portion 100, which may comprise a transfer station 540. The transfer station 540 may comprise at least some of substantially the same features and attributes as transfer station 102 of image formation device 20 in FIG. 1A.

In a manner similar to that previously described for image formation device 20, the various portions 40, 50, 60, 80, 100 of image formation device 500 in FIGS. 6-7 may operate as previously described in association with FIGS. 1A-5 to form an image on a print medium 546. As further shown in FIG. 6, in some examples the image formation device 500 comprises a sixth portion 130, which may comprise a dryer 530 or comprise another implementation of example energy transfer mechanism 362 in FIG. 5.

FIG. 8 is a diagram including a side view schematically representing at least a portion of an example image formation device 600. In some examples, image formation device 600 comprises at least some of substantially the same features as image formation device 20, 500 as previously described in association with FIGS. 1A-7, except with transfer member 22 arranged in the form of, or as part of, an endless belt or web 611 and with the various portions 40, 50, 60, 80, 100, etc. of image formation device 600 arranged in a pattern along belt 611 which travels in an endless loop, as shown in FIGS. 6-7. For illustrative simplicity, the various portions 40, 50, 60, 80, 100 of image formation device 600 are represented via boxes instead of dashed lines as in FIG. 1A and FIG. 9.

In some examples, transfer belt 611 forms part of a belt assembly 610 including various rollers 612, 614, 616, 618, 620, etc. and related mechanisms to guide and support travel of belt 611 (e.g. transfer member 22 in FIG. 1A) along travel path T and through the various portions 40, 50, 60, 80, 100, etc. of image formation device 600.

In a manner similar to that previously described for image formation device 20, the various portions 40, 50, 60, 80, 100, etc. operate as previously described in association with FIGS. 1A-7 to form an image on a print medium 546. As further shown in FIG. 8, in some examples the image formation device 600 comprise a fifth portion 100, which may comprise a transfer station 630 comprising at least some of substantially the same features and attributes as the previously described transfer stations (e.g. 102 in FIG. 1A; 540 in FIG. 6). In some instances, the roller 620 may serve as, or be referred to, as an impression cylinder. As in the image formation device 500 of FIG. 6, the sixth portion 130 in the image formation device 600 of FIG. 8 also may comprise a dryer 530 or another implementation of example energy transfer mechanism 362 in FIG. 5.

As previously described in association with at least FIGS. 1A-7, in some examples the first portion 40 may comprise a first receiving portion 510 (FIGS. 6-7) to removably receive a developer unit 202 and/or the second portion 50 may comprise a second receiving portion 520 (FIGS. 6-7) to removably receive a fluid ejection device 321.

Figure 9:
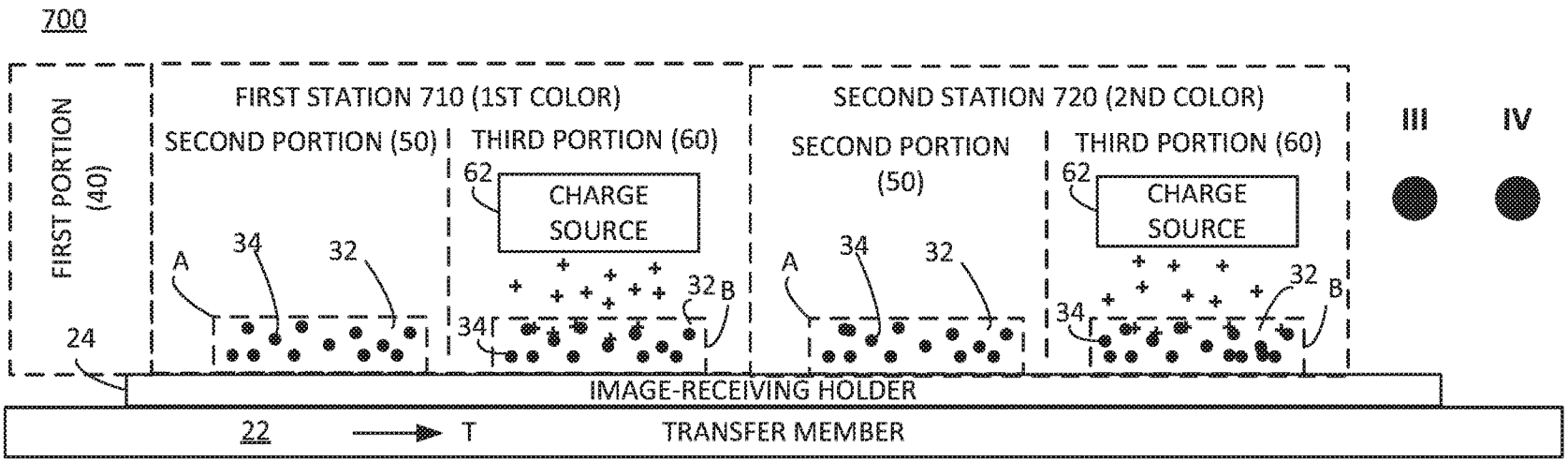
FIG. 9 is a diagram including a side view schematically representing multiple stations for multi-color printing in an example image formation device.

FIG. 9 is a diagram including a side view schematically representing at least a portion of an example image formation device 700. In some examples, the image formation device 700 comprises a transfer member 722 and a series of stations 710, 720, etc. arranged along the travel path T of the transfer member 22 in which each station is to provide one color ink of a plurality of different color inks onto the media. It will be further understood that FIG. 9 also may be viewed as schematically representing at least some aspects of an example method of image formation.

In some examples, the image formation device 700 comprises at least some of substantially the same features and attributes as the image formation devices 20, 500, 600, as previously described in association with FIGS. 1A-8. However, in image formation device 700 a series of image formation stations 710, 720 etc. is provided along a travel path of the transfer member 22. It will be understood that the image formation device 700 can be implemented with the transfer member 22 as a belt (FIG. 8) or as a drum (FIGS. 6-7) and the various first, second portions, etc. appropriately arranged to such configuration.

In a manner at least substantially the same as in the examples in FIGS. 1A-8, a first portion 40 is located upstream from the series of stations 710, 720 in order to provide an image-receiving holder 24 on a transfer member 22. Following the first portion 40, each subsequent, different image formation station 710, 720, etc. provides for at least partial formation of an image on the image-receiving holder 24 (carried by transfer member 22) by a respectively different color ink. Stated differently, the different stations apply different color inks such that a composite of the differently colored applied inks forms a complete image on the image-receiving holder 24 as desired. In some examples, the different color inks correspond to the different colors of a color separation scheme, such as Cyan (C), Magenta (M), Yellow (Y), and black (K) wherein each different color is applied separately as a layer to the image-receiving holder 24 as image-receiving holder 24 (as supported by transfer member 22) moves along travel path T.

As shown in FIG. 9, each station 710, 720, etc. may comprise at least a second portion 50 and a third portion 60 having substantially the same features as previously described. In some examples, each station may comprise additional portions, such as but not limited to, portion 80 as described in association with at least FIGS. 1A-8.

As further shown in FIG. 9, the image formation device 700 may comprise additional stations, and as such, the black circles III, IV represent further stations like stations 710, 720 for applying additional different color inks onto an image-receiving holder 24 (as carried by transfer member 22). In some examples, the additional stations may comprise a fewer number or a greater number of additional stations (e.g. III, IV) than shown in FIG. 9.

In some examples, each station 710, 720, etc. of image formation device 700 can include its own liquid removal element (e.g. 82 in FIG. 1A).

However, in some examples, image formation device 700 comprises just one fourth portion 80 (including at least one liquid removal element(s) 82) which is located downstream from multiple color stations 710, 720, etc. such that the cumulative excess liquid (from printing at those stations) is removed all at once. Stated differently, each of the respective color stations 710, 720 omit a liquid removal element (e.g. 82) and liquid removal does not take place until after the last color station in the series of color stations 710, 720, etc.

In some examples, the image formation device 700 may comprise at least one dryer or other implementation of an energy transfer mechanism (e.g. 362 in FIG. 5, 530 in FIG. 6) downstream from the multiple color stations 710, 720, with the at least one dryer being downstream along the travel path T from the last liquid removal element(s) 82 at the end of the multiple color stations 710, 720, etc.

In some examples, the image formation device 700 also may comprise a fifth portion 100 downstream from the multiple stations 710, 720, etc. and which comprises a transfer station comprising at least some of substantially the same features and attributes as transfer station 102 in FIG. 1A, 540 in FIG. 6, 630 in FIG. 8, etc.

Accordingly, upon the completion of each respective station (e.g. 710, 720), a layer of ink particles 34 will be fixed to the substrate 24, such that later stations will add additional layers of ink particles 34 (of different colors) onto the previous layer(s) of fixed ink particles 34. It will be understood that, for illustrative simplicity, station 720 in FIG. 9 omits depiction of a previously deposited, fixed layer of ink particles from station 710.

Figure 10A:
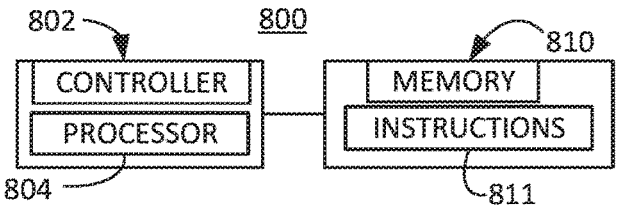
FIGS. 10A and 10B are a block diagram schematically representing an example control portion and an example user interface, respectively.

FIG. 10A is a block diagram schematically representing an example control portion 800. In some examples, control portion 800 provides one example implementation of a control portion forming a part of, implementing, and/or generally managing the example image formation devices 20, 500, 600, 700 as well as the particular stations, portions, elements, devices, user interface, instructions, engines, and/or methods, as described throughout examples of the present disclosure in association with FIGS. 1A-9 and 11.

In some examples, control portion 800 includes a controller 802 and a memory 810. In general terms, controller 802 of control portion 800 comprises at least one processor 804 and associated memories. The controller 802 is electrically couplable to, and in communication with, memory 810 to generate control signals to direct operation of at least some the image formation devices, various portions, stations, devices, and/or elements of the image formation devices, such as but not limited to, developer units, fluid ejection devices, charge sources, liquid removal portions, liquid removal, dryers, transfer stations, user interfaces, instructions, engines, functions, and/or methods, as described throughout examples of the present disclosure. In some examples, these generated control signals include, but are not limited to, employing instructions 811 stored in memory 810 to at least direct and manage developing and/or applying an image-receiving holder onto a transfer member, depositing droplets of ink particles and carrier fluid to form an image on a media, directing charges onto ink particles, removing liquids, transferring ink and image-receiving holder onto a print medium, performing stochastic-type screening (i.e. frequency modulation image formation), etc. as described throughout the examples of the present disclosure in association with FIGS. 1A-9 and 11. In some instances, the controller 802 or control portion 800 may sometimes be referred to as being programmed to perform the above-identified actions, functions, etc. In some examples, at least some of the stored instructions 811 are implemented as a, or may be referred to as, an image formation engine or print engine.

In response to or based upon commands received via a user interface (e.g. user interface 820 in FIG. 10B) and/or via machine readable instructions, controller 802 generates control signals as described above in accordance with at least some of the examples of the present disclosure. In some examples, controller 802 is embodied in a general purpose computing device while in some examples, controller 802 is incorporated into or associated with at least some of the image formation devices, portions, stations, and/or elements along the travel path, developer units, fluid ejection devices, charge sources, liquid removal portions, liquid removal, dryers, transfer stations, user interfaces, instructions, engines, functions, and/or methods, etc. as described throughout examples of the present disclosure.

For purposes of this application, in reference to the controller 802, the term "processor" shall mean a presently developed or future developed processor (or processing resources) that executes sequences of machine readable instructions contained in a memory. In some examples, execution of the sequences of machine readable instructions, such as those provided via memory 810 of control portion 800 cause the processor to perform the above-identified actions, such as operating controller 802 to implement the formation of an image as generally described in (or consistent with) at least some examples of the present disclosure. The machine readable instructions may be loaded in a random access memory (RAM) for execution by the processor from their stored location in a read only memory (ROM), a mass storage device, or some other persistent storage (e.g., non-transitory tangible medium or non-volatile tangible medium), as represented by memory 810. In some examples, memory 810 comprises a computer readable tangible medium providing non-volatile storage of the machine readable instructions executable by a process of controller 802. In other examples, hard wired circuitry may be used in place of or in combination with machine readable instructions to implement the functions described. For example, controller 802 may be embodied as part of at least one application-specific integrated circuit (ASIC). In at least some examples, the controller 802 is not limited to any specific combination of hardware circuitry and machine readable instructions, nor limited to any particular source for the machine readable instructions executed by the controller 802.

In some examples, control portion 800 may be entirely implemented within or by a stand-alone device.

In some examples, the control portion 800 may be partially implemented in one of the image formation devices and partially implemented in a computing resource separate from, and independent of, the image formation devices but in communication with the image formation devices. For instance, in some examples control portion 800 may be implemented via a server accessible via the cloud and/or other network pathways. In some examples, the control portion 800 may be distributed or apportioned among multiple devices or resources such as among a server, an image formation device, and/or a user interface.

Figure 10B:
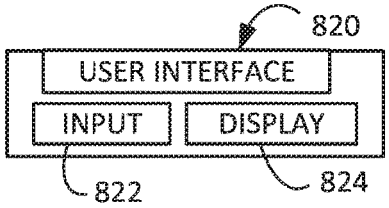

In some examples, control portion 800 includes, and/or is in communication with, a user interface 820 as shown in FIG. 10B. In some examples, user interface 820 comprises a user interface or other display that provides for the simultaneous display, activation, and/or operation of at least some of the image formation devices, stations, portions, elements, user interfaces, instructions, engines, functions, and/or methods, etc. as described in association with FIGS. 1-10A and 11. In some examples, at least some portions or aspects of the user interface 820 are provided via a graphical user interface (GUI), and may comprise a display 824 and input 822.

Figure 11:
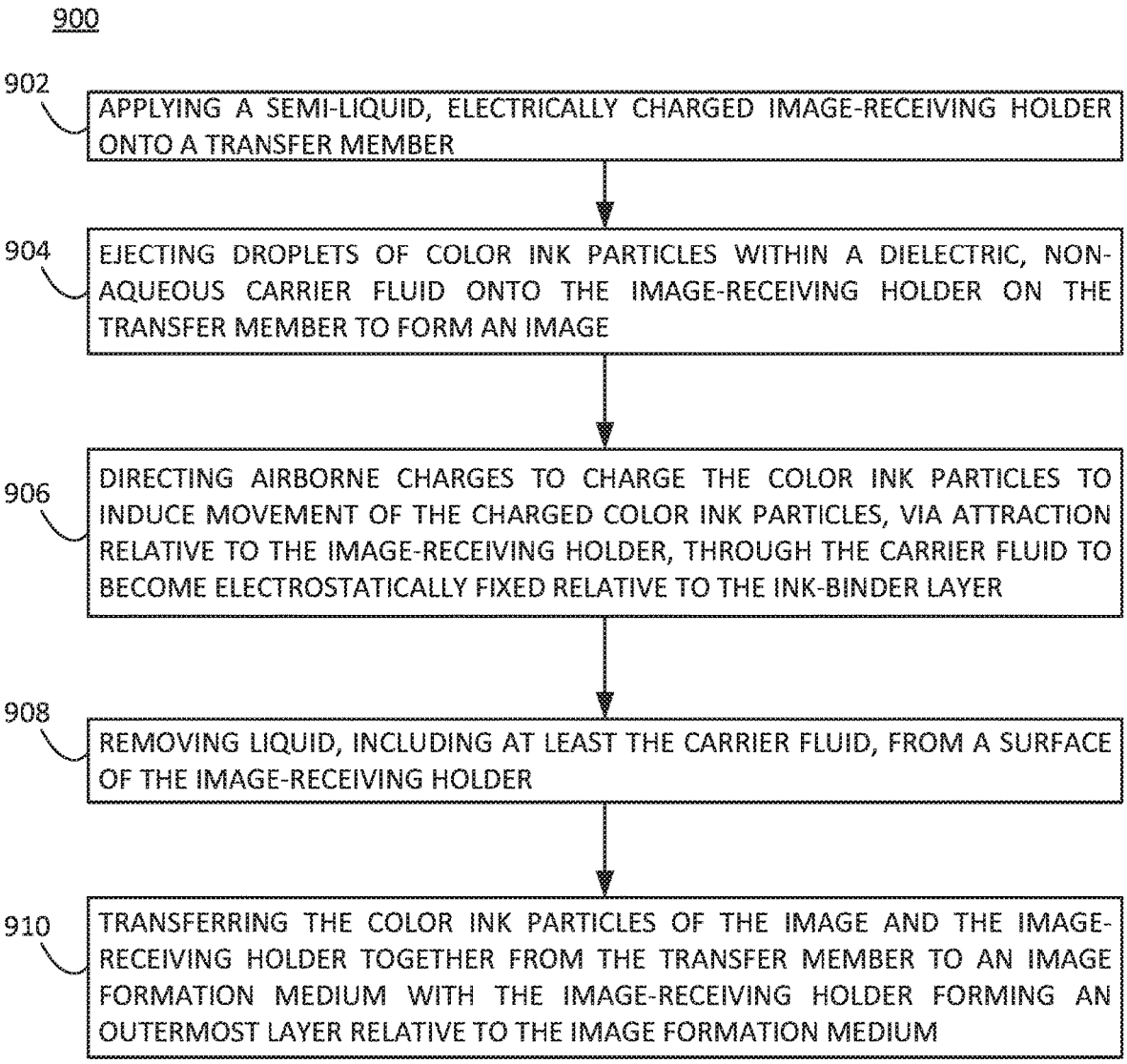
FIG. 11 is a flow diagram schematically representing an example method of image formation.

FIG. 11 is a flow diagram schematically representing an example method. In some examples, method 900 may be performed via at least some of the same or substantially the same devices, portions, stations, elements, control portion, user interface, methods, etc. as previously described in association with FIGS. 1A-10B. In some examples, method 900 may be performed via at least some devices, portions, stations, elements, control portion, user interface, methods, etc. other than those previously described in association with FIGS. 1A-10B.

As shown at 902 of FIG. 11, in some examples method 900 comprises applying an electrically charged, semi-liquid image-receiving holder onto a transfer member while at 904, method 900 comprises ejecting droplets of color ink particles within a dielectric, non-aqueous carrier fluid to form an image on the electrically charged, image-receiving holder supported by the transfer member. As shown at 906, in some examples method 900 comprises directing airborne charges to charge the color ink particles to induce movement of the charged color ink particles, via attraction relative to the electrically charged, image-receiving holder, through the carrier fluid to become electrostatically fixed relative to the image-receiving holder. As shown at 908, in some examples method 900 comprises removing liquid, including at least the carrier fluid, from a surface of the electrically charged, image-receiving holder. As shown at 910, in some examples method 900 comprises transferring the color ink particles of the image and the image-receiving holder together from the transfer member to an image formation medium with the image-receiving holder forming an outermost layer relative to the image formation medium.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. An image formation device comprising:

a transfer member comprising at least one of a belt and a drum;

a first portion along a travel path of the transfer member to receive an electrically charged, semi-liquid non-aqueous image-receiving holder onto the transfer member;

a second portion downstream along the travel path from the first portion to receive a pattern of droplets of color ink particles within a dielectric, non-aqueous carrier fluid onto the electrically charged, semi-liquid non-aqueous image-receiving holder to form an image;

a charge source downstream along the travel path from the second portion to emit airborne charges to charge the patterned, color ink particles to move, via attraction relative to the electrically charged, non-aqueous image-receiving holder, through the non-aqueous carrier fluid to become electrostatically fixed in the pattern relative to the image-receiving holder;

a liquid removal unit downstream along the travel path from the charge source, and positioned relative to the transfer member, to remove at least a portion of the non-aqueous carrier fluid from a surface of the electrically charged, non-aqueous image-receiving holder, the liquid removal unit comprising at least one of a mechanical element and a drying element; and a transfer station downstream along the travel path from the liquid removal unit to transfer the ink particles of the image and the electrically charged, non-aqueous image-receiving holder together from the transfer member to an image formation medium, wherein the transfer station comprises a roller.

2. The device of claim 1, wherein the first portion comprises a developer unit, which comprises:

a container to hold materials;

at least one electrode positioned within the container; and a rotatable drum in communication with the materials in the container and positioned relative to the at least one electrode and relative to the transfer member to apply, upon rotation of the drum, the materials as the electrically charged, semi-liquid non-aqueous image-receiving holder onto the transfer member.

3. The device of claim 2, wherein the developer unit is to apply the electrically charged, non-aqueous image-receiving holder as a layer in a volume to cover at least substantially the entire surface of the transfer member at least in a region in which an image is to be formed on the electrically charged, semi-liquid non-aqueous image-receiving holder.

4. The device of claim 3, wherein the transfer station is to transfer at least substantially the entire electrically charged, semi-liquid non-aqueous image-receiving holder and at least substantially all of the color ink particles together to the image formation medium.

5. The device of claim 2, wherein the developer unit is to apply the electrically charged, semi-liquid non-aqueous image-receiving holder as including at least substantially all of a binder used to complete image formation on the image formation medium upon transfer of the color ink particles and the electrically charged, semi-liquid non-aqueous image-receiving holder from the transfer member to the image formation medium.

6. The device of claim 1, wherein the second portion comprises a fluid ejection device to eject the droplets within the dielectric carrier fluid onto the electrically charged, semi-liquid non-aqueous image-receiving holder.

7. The device of claim 6, wherein the fluid ejection device is to eject the droplets as substantially binder-free droplets.

8. The device of claim 1, wherein the liquid removal unit comprises at least one of:

a first liquid removal device downstream along the travel path from the charge source and including the mechanical element positioned relative to the transfer member to mechanically remove at least a first portion of the dielectric, non-aqueous carrier fluid from the dielectric, semi-liquid non-aqueous image-receiving holder, wherein the removed first portion comprises at least 80 percent of the dielectric, non-aqueous carrier fluid received onto the electrically charged, semi-liquid image-receiving holder; and a second liquid removal device downstream from the first liquid removal device and including the drying element, which comprises:

a heated air element to direct heated air onto at least the carrier fluid; or a radiation device to direct at least one of IR radiation and UV radiation onto at least the carrier fluid.

9. A device comprising:

a transfer member comprising at least one of a belt and a drum;

a first portion along a travel path of the transfer member to receive an electrically charged, non-aqueous image-receiving holder onto the transfer member;

a series of stations arranged along the travel path, downstream from the first portion, in which each station is to provide one color ink of a plurality of different color inks onto the transfer member, and wherein each station comprises:

a second portion along the travel path to receive droplets of ink particles within a dielectric, non-aqueous carrier fluid onto the electrically charged, non-aqueous image-receiving holder on the transfer member to form at least a portion of an image thereon;

a charge source downstream along the travel path from the second portion, to emit airborne charges to charge the color ink particles to move, via attraction relative to the electrically charged, non-aqueous image-receiving holder, through the dielectric, non-aqueous carrier fluid to become electrostatically fixed relative to the electrically charged, non-aqueous image-receiving holder;

a liquid removal unit positioned relative to the transfer member to remove at least a first portion of the dielectric, non-aqueous carrier fluid from a surface of the electrically charged, non-aqueous image-receiving holder, the liquid removal unit comprising at least one of a mechanical element and a drying element and wherein the removed first portion comprises at least 80 percent of the dielectric, non-aqueous carrier fluid received onto the electrically charged, semi-liquid image-receiving holder; and a transfer station to transfer the ink particles of the image and the electrically charged, non-aqueous image-receiving holder together from the transfer member to an image formation medium, wherein the transfer station comprises a roller.

10. The device of claim 9, wherein the first portion comprises a developer unit, which comprises:

a container to hold materials;

at least one electrode positioned within the container; and a rotatable drum in communication with the materials in the container and positioned relative to the at least one electrode and relative to the transfer member to apply, upon rotation of the drum, the materials as the electrically charged, non-aqueous image-receiving holder onto the transfer member, and wherein the device further comprises:

a control portion including a processor and a non-transitory medium storing instructions, executable on the processor, to cause the developer unit to apply the image-receiving holder on the transfer member in a volume to uniformly cover at least substantially the entire surface of the transfer member in a region of the transfer member in which the image is formed.

11. The device of claim 10, wherein the second portion comprises a fluid ejection device to eject the droplets, as substantially binder-free, within the dielectric, non-aqueous carrier fluid onto the electrically charged, non-aqueous image-receiving holder.

12. A method comprising:

applying an electrically charged, semi-liquid non-aqueous first image formation medium onto a transfer member, which comprises a roller;

ejecting droplets of color ink particles within a first dielectric, non-aqueous carrier fluid in at least one pattern onto the electrically charged, semi-liquid non-aqueous first image formation medium on the transfer member to form an image;

directing airborne charges to charge the at least one pattern of color ink particles to induce movement of the charged color ink particles, via attraction relative to the electrically charged, semi-liquid non-aqueous first image formation medium, through the first dielectric, non-aqueous carrier fluid to become electrostatically fixed in the at least one pattern of the image relative to the electrically charged, semi-liquid non-aqueous first image formation medium;

removing liquid, including at least the first dielectric, non-aqueous carrier fluid, from a surface of the electrically charged, semi-liquid non-aqueous first image formation medium; and electrostatically transferring the at least one pattern of color ink particles of the image and the electrically charged, semi-liquid non-aqueous first image formation medium together from the transfer member to a second image formation medium with the electrically charged, semi-liquid non-aqueous first image formation medium forming an outermost layer of an image formation medium assembly.

13. The method of claim 12, wherein the applying the non-aqueous, first image formation medium comprises applying the non-aqueous, first image formation medium as a volume sufficient to uniformly cover at least substantially the entire surface of the transfer member in a region of the transfer member in which the image is to be formed.

14. The method of claim 12, wherein ejecting the droplet comprises performing the ejecting of droplets as substantially binder-free droplets, and wherein applying the semi-liquid non-aqueous, first image formation medium comprises arranging the semi-liquid non-aqueous, first image formation medium to include at least substantially an entire binder used to at least partially secure image formation on the semi-liquid non-aqueous, first image formation medium and relative to a second image formation medium upon transfer of the color ink particles and the semi-liquid non-aqueous, first image formation medium from the transfer member onto the second image formation medium.

15. The method of claim 14, comprising:

arranging the droplets to be substantially charge-director-free and arranging the semi-liquid non-aqueous, first image formation medium to comprise charge director additives and a binder material within a second dielectric, non-aqueous carrier fluid, wherein the semi-liquid non-aqueous, first image formation medium comprises at least about 20 percent solids and the second dielectric, non-aqueous carrier fluid comprises at least about 50 percent of the weight of the non-aqueous, first image formation medium.

16. The method of claim 12, comprising:

implementing the removing liquid via removing at least 80 percent of the first dielectric, non-aqueous carrier fluid which was ejected onto the electrically charged, semi-liquid non-aqueous first image formation medium.

* * * * *